United States Patent [19]

Nongbri

[11] 4,443,330

[45] Apr. 17, 1984

[54] CATALYST ACTIVITY IN COAL LIQUID UPGRADING

[75] Inventor: Govanon Nongbri, Newton, Pa.

[73] Assignee: HRI, Inc., Lawrenceville, N.J.

[21] Appl. No.: 269,113

[22] Filed: Jun. 1, 1981

[51] Int. Cl.[3] ..... C10G 47/12

[52] U.S. Cl. ..... 208/112; 208/10; 208/108; 208/215; 502/216; 502/219; 502/222

[58] Field of Search ..... 208/10, 108, 215, 112; 252/436, 439

[56] References Cited

U.S. PATENT DOCUMENTS

| | | | |
|---|---|---|---|
| 1,852,988 | 4/1932 | Varga | 208/108 X |
| 1,894,926 | 1/1933 | Varga | 252/439 X |
| 2,946,738 | 7/1960 | Gardner et al. | 208/215 X |
| 4,048,058 | 9/1977 | Petersen et al. | 208/138 |
| 4,161,440 | 7/1979 | Brunson | 208/10 X |
| 4,197,136 | 12/1979 | Herrington et al. | 208/215 |
| 4,264,430 | 4/1981 | Kuehler | 208/10 |
| 4,298,451 | 11/1981 | Neuworth | 208/10 X |

*Primary Examiner*—Patrick Garvin
*Assistant Examiner*—George E. Schmitkons
*Attorney, Agent, or Firm*—V. A. Mallare; F. A. Wilson

[57] ABSTRACT

An improved process for upgrading a coal liquid where the coal liquid is catalytically converted by hydrogenating and hydrocracking. In the process of upgrading a coal liquid where the coal liquid is fed with hydrogen into a catalytic reactor, the improvement comprises the feeding of a sulfur-containing liquid with the coal liquid. The sulfur-containing liquid ranges from about 0.2 to about 2.0 weight percent of the coal liquid feed. The sulfur-containing liquid is a high boiling hydrocarbon sulfur compound of the formula $RSR_1$, where R is an alkyl group having 2 to 20 carbon atoms or a phenyl group and $R_1$ is H, an alkyl group having 2 to 20 carbon atoms or a phenyl group.

12 Claims, 5 Drawing Figures

ONCE-THROUGH OPERATION

RECYCLE OPERATION

FIXED-BED OPERATION

CATALYST ACTIVITY IN COAL LIQUID UPGRADING

BACKGROUND OF THE INVENTION

This invention relates to the upgrading of coal liquids hydrogenation and more particularly to a method for improving the activity of the catalyst used in the upgrading of coal liquids.

The upgrading of coal liquids consists of (1) hydrocracking of large molecules and (2) heteroatoms removal. In order to crack the large and complex molecules, these molecules have to be hydrogenated before they are cracked. Thus, to hydrocrack these large molecules, a good hydrogenation catalyst is essential. A good hydrogenation catalyst will serve the purpose of both the hydrogenation of the large molecules and removal of heteroatoms.

In the upgrading of coal liquids, the catalyst which is used, e.g., in an ebullated bed reactor, is generally presulfided before making contact with a coal liquid feed. This is essential in that the catalyst should be in a sulfided state in order to obtain maximum hydrogenation activity in the upgrading process. However, in the treatment of a coal liquid, the catalyst as it ages loses some of the sulfur and does not have a sufficient amount of sulfur to remain in the desired sulfided state. During the coal liquid upgrading process, the sulfur which has been placed on the catalyst during presulfiding, is removed by ammonia which evolves from the coal liquid feed.

Moreover, in coal liquid upgrading by hydrotreating, the sulfiding of the hydrotreating catalyst from feed sulfur and $H_2S$ in the reactor system is often not enough to maintain its activity because of (a) a low concentration of sulfur in the feed, and (b) a high nitrogen content of feed which results in a high ammonia yield which in turn consummes $H_2S$ to form sulfide compounds of ammonia.

The presulfiding of the catalyst will maintain the activity of the catalyst initially but unless there is an adequate amount of sulfur concentration maintained in the catalyst, the activity of the catalyst will diminish. Therefore, there is a need to provide additional sulfur in the reaction process so that the catalyst will be maintained in a sulfided state, i.e., an active state for hydrogenation.

According to the present invention as described below, the catalyst activity can be maintained by adding a non-corrosive compound such as a mercaptan along with the coal liquid feed.

SUMMARY OF THE INVENTION

This invention provides an improvement in a coal liquid upgrading process where a coal liquid is catalyticallly upgraded by hydrogenation and hydrocracking in an ebullated bed or fixed bed catalytic reactor.

According to the present invention, the improvement comprises the feeding of a sulfur-containing liquid along with the coal liquid feed to a catalytic reactor. The sulfur-containing liquid ranges from about 0.2 to about 2.0 weight percent of the coal liquid feed. The sulfur-containing liquid is a high boiling hydrocarbon sulfur compound of the formula $RSR_1$, where R is an alkyl group having 2 to 20 carbon atoms or a phenyl group and $R_1$ is H, an alkyl group having 2 to 20 carbon atoms or a phenyl group.

BRIEF DESCRIPTION OF THE INVENTION

The preferred arrangements for carrying out the present invention have been chosen for purposes of illustration and description in the accompanying drawings which form a part of the specification and wherein.

and

Figure 3:
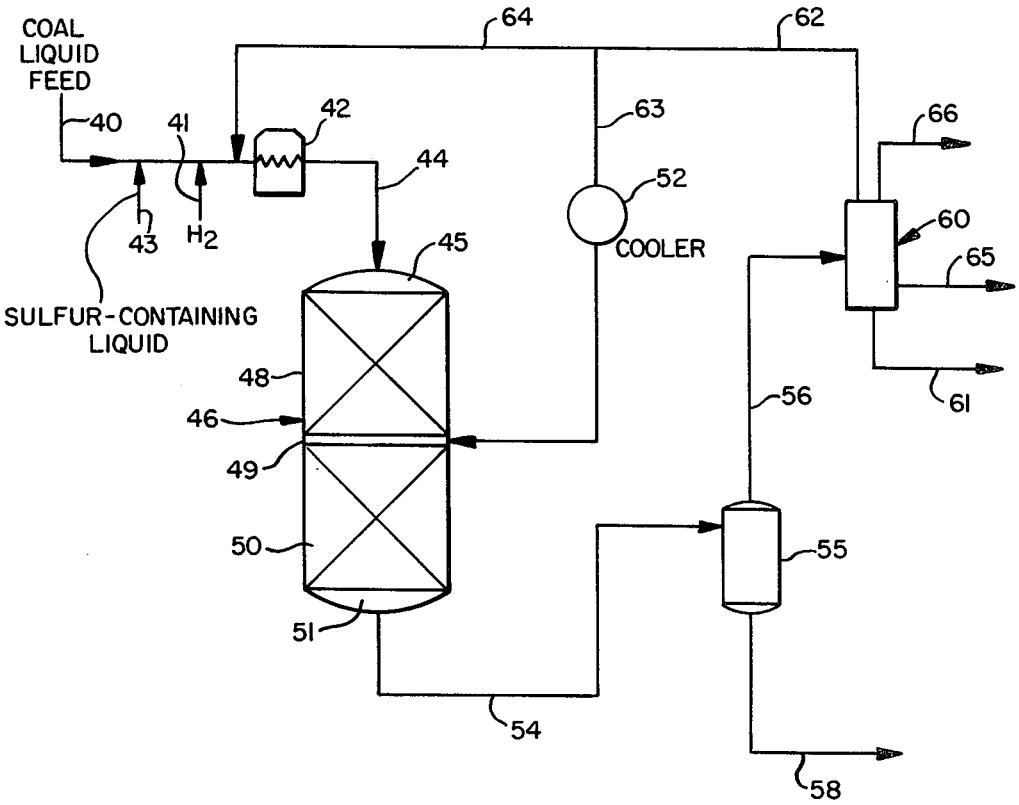

FIG. 3 is a schematic drawing illustrating the operation of the present invention in a fixed bed reactor.

FIG. 4 and FIG. 5 illustrate the results of upgrading.

PREFERRED EMBODIMENT OF THE INVENTION

In the upgrading of a coal liquid where the coal liquid is catalytically hydrogenated and cracked, the coal liquid may be fed into an ebullated catalytic bed reactor or fixed bed reactor, where the catalyst is any suitable catalyst such as an alumina based catalyst of a Group VI, VII, or VIII metal oxide.

The catalyst, a metal oxide, is most active as a sulfide compound. Thus, the metal oxides in the catalyst have to be converted to metal sulfides in order to obtain there best performance. In processing high sulfur feeds, the oxides in the catalyst are converted to sulfides by sulfur and $H_2S$ that are present in the reactor. However, with coal liquids, extraneous sulfur compounds need to be added with the feed to maintain the presulfided catalyst in the sulfide state.

According to this invention the presulfided catalyst, used in upgrading coal liquids, attains a sulfur level below that which is needed to maintain it in the sulfided state. As a result of this insufficiency the performance as indicated by conversion to lighter products deteriorates as the catalyst ages, i.e., conversion falls off from that initially accomplished with a presulfided catalyst.

In maintaining the catalyst at a sulfur level that is necessary for carrying out the process of hydrocracking, a sulfur-containing liquid is added with the coal liquid fed into the reactor. The sulfur-containing liquid tends to stabilize and maintain the sulfur level sufficient for the catalyst to be in a fully sulfided state which is needed for carrying out the conversion of the coal liquid for future reasons.

The added sulfur-containing liquid is generally between about 0.2 and about 2.0 weight percent of the coal liquid feed. Preferably, the sulfur-containing liquid added is about 1.0 weight percent of the coal liquid feed.

In the process, the sulfur-containing liquid is preferably any high boiling hydrocarbon sulfur compound. The sulfur-containing liquid in order to be more effective should have a high boiling point so that it is maintained as a liquid under reactor conditions. The boiling point for the sulfur-containing liquid ranges between about 250° F. and about 700° F. Preferably, the boiling point of the sulfur-containing liquid is at least about 500° F.

The sulfur-containing liquid may be a high boiling hydrocarbon sulfur compound of the formula $RSR_1$, where R is an alkyl group having 2 to 20 carbon atoms or a phenyl group and $R_1$ is H, an alkyl group having 2 to 20 carbon atoms or a phenyl group.

The sulfur-containing liquid may be a sulfide selected from the group consisting of methyl disulfide, dipropyl sulfide, 2-phenyl sulfide, diphenyl sulfide, dodecyo disulfide, hexane dithiol and n-butyl sulfide.

In the process, the reactions are generally carried out under a hydrogen partial pressure ranging from about 1500 to about 3000 psig. The preferred pressure is about 2250 psig hydrogen partial pressure. The temperature under which the reactions are carried out ranges from about 750° F. to about 840° F.

The coal liquid and sulfur-containing liquid are fed into the reactor at a space velocity ranging from about 0.2 to about 1.5 cuft/hr/cuft of reactor volume.

The catalyst bed in the ebullated bed reactor is withdrawn and replaced at a rate ranging from about 0.05 to about 1.0 lb/barrel of coal liquid fed to help maintain the desired catalyst activity.

Figure 1:
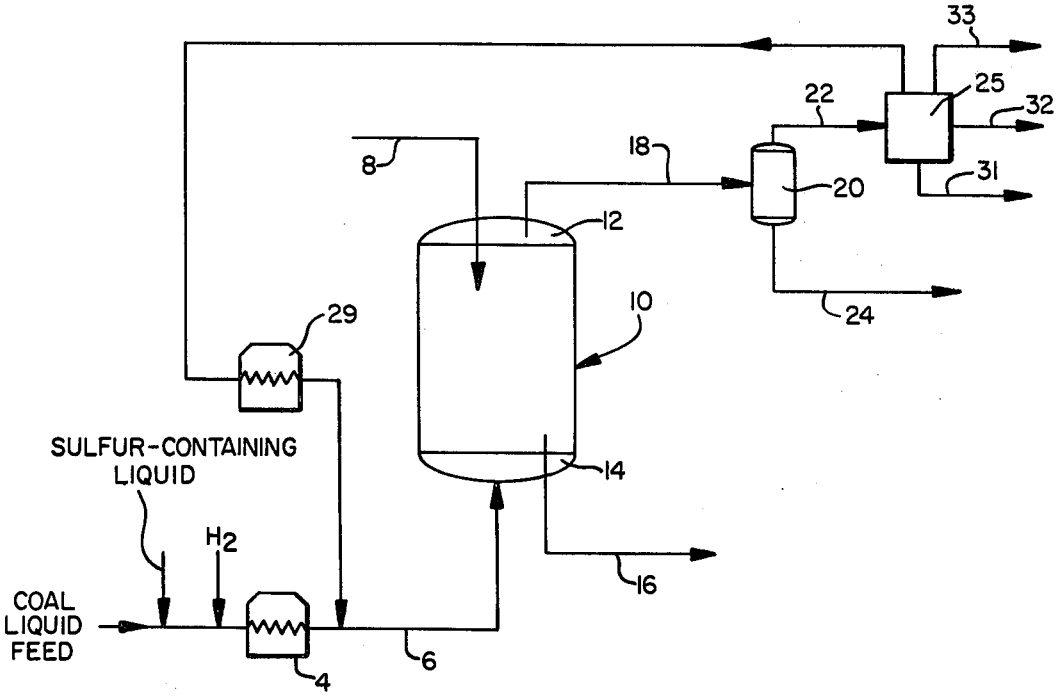
FIG. 1 is a schematic drawing illustrating the once-through operation of the present invention in an ebullated bed reactor.

Referring to FIG. 1, there is schematically shown, a oncethrough operation of the present invention. As shown, a coal liquid feed with hydrogen and a sulfur-containing liquid are heated at 4 and fed through conduit 6 into the bottom 14 of the ebullated bed reactor 10. In the top 12 of the reactor 10, a catalyst is fed therein via line 8, and after the catalyst has been used, i.e., spent, the catalyst is withdrawn from the bottom 14 of the reactor 10 through line 16.

The coal liquid fed with the hydrogen and sulfur-containing liquid is passed through the reactor 10 and the effluent stream is passed out the top 12 through line 18 into a separator 20. In the separator, the effluent is split off into a vapor phase through line 22 and a liquid phase through line 24. The liquid phase of the effluent is a heavy distillate which can be further treated to provide products of higher value, e.g., a fuel oil or a heating oil.

The vapor or gaseous phase of the effluent which comprises hydrocarbons such as methane, propane and butane along with excess hydrogen is passed as feed through line 22 to a hydrogen purification unit 25 for recovery of medium purity hydrogen stream 27 (85–90% purity) which is recycled to the reactor 10 after reheating at heater 29. Fuel gases are withdrawn through line 32 and a vent gas is withdrawn through line 33.

From the bottom of the purification unit 25, a light distillate is drawn off through line 31. The light distillate is generally treated to provide products of higher value such as transportation fuels.

Figure 2:
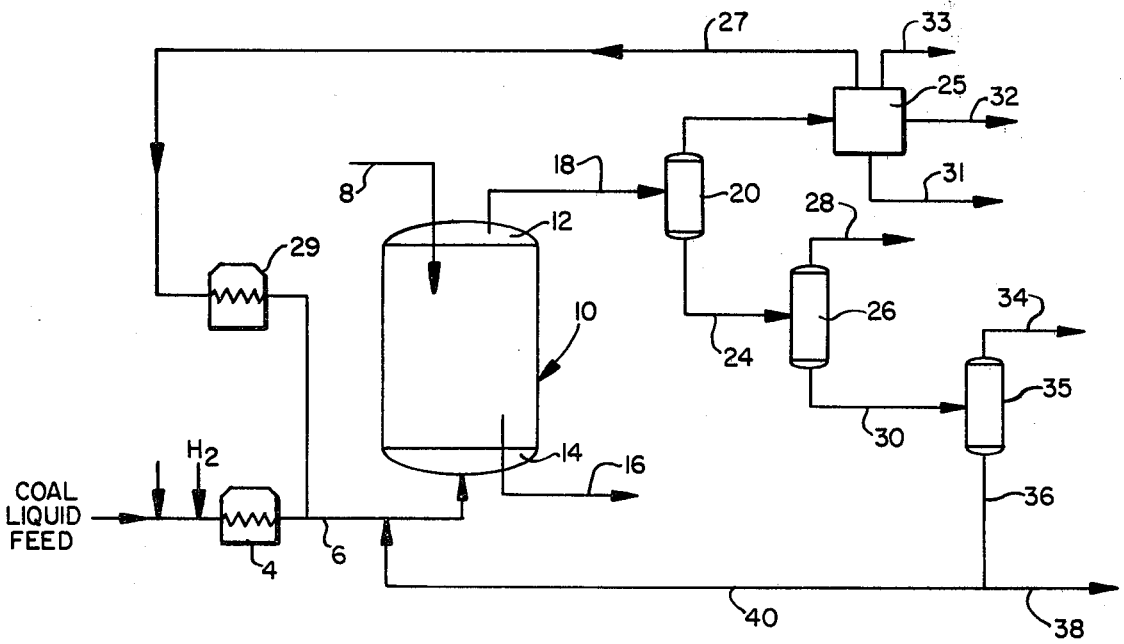
FIG. 2 is a schematic drawing illustrating the recycle operation of the present invention in an ebullated bed reactor.

Referring to FIG. 2, the upgrading of coal liquid using a liquid recycle operation is schematically shown. As shown, the coal-liquid feed is fed with a sulfur-containing liquid with hydrogen into the reactor 10 in the same manner as the once-through operation illustrated in FIG. 1. Also, the catalyst is passed into the reactor 10 in the same way as in the once-through operation. Similarly, the catalyst after being used, is removed from the bottom 14 of the reactor 10 through line 16.

In the recycle operation, as in the once-through operation, the coal liquid feed, hydrogen and sulfur-containing liquid, are passed through the reactor 10 and the effluent stream is passed to the separator 20 where the effluent is split off into a vapor phase through line 22 and a liquid phase through line 24 in the same manner as shown in FIG. 1 and described above in the once-through operation.

The vapor or gaseous phase split off from the effluent in separator 20, is comprised of hydrogen, $H_2S$, $NH_3$ and hydrocarbons such as methane, ethane and butane. This gaseous phase is passed as feed through line 22 to a hydrogen purification unit 25 for recovery of medium purity hydrogen stream 27 (85–90% purity) which is recycled to the reactor in the same manner described above in the once-through operation. A fuel gas stream is withdrawn at 32, and a vent stream at 33.

From the bottom of the purification unit 25, a light distillate is drawn off through line 31. The light distillate is generally treated to provide liquid products of higher value such as transportion fuels.

The liquid phase 24 of the reactor effluent is passed into an atmospheric distillation tower 26 and the liquid products produced in tower 26 are passed on through line 30 into a vacuum distillation tower 35. The vapor products from tower 26 are withdrawn from the process through line 28.

The liquid products passed into the vacuum tower 35 are separated, and a vapor phase is withdrawn through line 35 as a liquid phase is withdrawn from the bottom of the vacuum tower 35 through line 36. The liquid products are then passed from the process through line 38 as usable products, while a portion of the liquid phase products passed through line 36 are recycled through line 40 into line 6 along with the fresh coal liquid feed, hydrogen and sulfur-containing liquid fed into the reactor 10. The recycle process as illustrated in FIG. 2 is intended to be continuous where all of the liquid products of the coal liquid feed, hydrogen and sulfur-containing liquid, are utilized until expended. The liquid recycle operation results in producing more light products from the coal liquid feed.

In FIG. 3, the upgrading of coal liquids using a fixed bed catalytic reactor is shown. In the fixed bed operation, a coal liquid feed 40 with hydrogen at 41 and a sulfur-containing liquid 43 are heated at 42 and fed through conduit 44 into the top 45 of a fixed bed reactor 46. The feed mixture is passed through the upper fixed bed 48 where the temperature of the mixture feed increases from its entrance at the top 45 of the reactor 46 to area 49 between the upper fixed bed 48 and the lower fixed bed 50. Recycled hydrogen which has been cooled at 52 is fed at area 49 into the fixed bed reactor 46 to cool the coal liquid feed mixture. The feed mixture is cooled at the entrance of the lower fixed bed 50 to a temperature approximate to that at the entrance of the upper fixed bed 48. The temperature of the coal liquid mixture increases as it is passed through the lower fixed bed. The effluent out the bottom 51 of the lower fixed bed 50 of the reactor 46 is withdrawn through conduit 54 into a separator 55. In the separator 55, the effluent is split off into a vapor phase stream through line 56 and a liquid phase stream through line 58. The liquid phase of the effluent is a heavy distillate which can be further treated to provide products of a higher value, e.g., a fuel oil or a heating oil.

The vapor or gaseous phase stream 56 split off from separator 55 is comprised of hydrogen, $H_2S$, $NH_3$ and hydrocarbons such as methane, ethane, propane and butane. This gaseous phase is passed through line 56 to a hydrogen purification unit 60 for recovery of medium purity hydrogen stream 62 (85–90% purity). A sufficient quantity of this hydrogen is passed through conduit 63, cooled at 52 and fed into the reactor 46 at area 49 to cool the coal liquid mixture passing from the upper fixed bed 48 to the lower fixed bed 50. The rest of the hydrogen stream 62 is recycled at 64 to the reactor 46 having heating at 65.

Returning now to the hydrogen purification unit 60 and as shown in FIG. 3, a light distillate liquid is drawn off through line 61. The light distillate is generally treated to provide products of higher value such as transportation fuels. A fuel gas stream is withdrawn at 65, and a vent gas stream at 66.

The advantages and the use of the present invention are illustrated in the following example which is not intended to be limiting in scope.

EXAMPLE

Generally, the upgrading of coal liquids consists of first, the hydrocracking of large molecules and then, removal of heteroatoms. In order to crack the large and complex molecules, these molecules have to be hydrogenated before they are cracked. Thus, according to the present invention, it has been found that not only is a good hydrogenation catalyst needed in effectively upgrading coal liquids but also a catalyst which is in a fully sulfided state.

In order to substantiate this finding, the effectiveness (i.e., activity) of a typical coal hydrogenation catalyst in upgrading a coal liquid over a period of days was recorded. The results of such upgrading are illustrated below in FIGS. 4 and 5.

As shown in FIG. 4, the catalyst effectiveness (i.e., percent conversion of coal liquid) in a period of about eleven days has decreased by about 35%, i.e., a drop from about 96% to about 61% conversion of coal liquid. The sulfur content of the catalyst at point (2) was 2.2% lower than is needed to be in a fully sulfided state (i.e., effective state).

In FIG. 5 the operation was carried out with a vacuum resid oil having high sulfur content (5.0%). The used catalyst from this operation contained sulfur sufficient to be in the sulfided state. This percent conversion of feed in this experiment did not shown as sharp a decline as that illustrated in FIG. 4.

I claim:

1. In a process of upgrading of coal liquid where the coal liquid is fed with hydrogen into a catalytic reactor wherein the catalyst is an alumina based catalyst of a Group VI, VII or VIII metal oxide, the improvement comprises feeding a sulfur-containing liquid having a boiling point range from about 250° F. to about 700° F. with the coal liquid being fed at a space velocity ranging from about 0.2 to about 1.5 cuft/hr/cuft of reactor volume and under a pressure ranging from about 1500 to about 3000 psig hydrogen partial pressure, said sulfur-containing liquid being fed in an amount of between about 0.2 and about 2.0 weight percent of said coal liquid feed.

2. In a process according to claim 1, wherein said catalytic reactor is an ebullated bed reactor.

3. In a process according to claim 1, wherein said catalytic reactor is a fixed bed reactor.

4. In a process according to claim 1, wherein said sulfur-containing liquid is a high boiling hydrocarbon sulfur compound of the formula $RSR_1$, where R is an alkyl group having 2 to 20 carbon atoms or a phenyl group and $R_1$ is H, an alkyl group having 2 to 20 carbon atoms or a phenyl group.

5. In a process according to claim 1, wherein said catalyst is withdrawn and replaced at a rate of between about 0.05 and about 1.0 lb/barrel of coal liquid feed.

6. In a process according to claim 1, wherein said process is carried out under a temperature ranging from about 750° F. to about 840° F.

7. In a process according to claim 1, wherein said sulfur-containing liquid is selected from the group consisting of methyl disulfide, hexane dithiol, dipropyl sulfide, 2-phenyl sulfide, diphenyl disulfide, dodecyl sulfide and n-butyl sulfide.

8. In a process according to claim 7, wherein said sulfur-containing liquid is methyl disulfide.

9. In a process according to claim 7, wherein said sulfur-containing liquid is n-butyl sulfide.

10. In a process according to claim 7, wherein said sulfur-containing liquid is hexane dithiol.

11. In a process according to claim 7, wherein said sulfur-containing liquid is diphenyl disulfide.

12. In a process according to claim 7, wherein said sulfur-containing liquid is dodecyl sulfide.

* * * * *